US012172859B2

(12) United States Patent
Chatry et al.

(10) Patent No.: US 12,172,859 B2
(45) Date of Patent: Dec. 24, 2024

(54) SHEET PILE SUPPORTING ASSEMBLY AND METHOD FOR OPERATING A SHEET PILE SUPPORTING ASSEMBLY

(71) Applicant: BOBST MEX SA, Mex (CH)

(72) Inventors: Patrice Chatry, Lugrin (FR); Maude Steiner, Morrens (CH)

(73) Assignee: BOBST MEX SA, Mex (CH)

( * ) Notice: Subject to any disclaimer, the term of this patent is extended or adjusted under 35 U.S.C. 154(b) by 266 days.

(21) Appl. No.: 17/905,664

(22) PCT Filed: Feb. 26, 2021

(86) PCT No.: PCT/EP2021/054905
§ 371 (c)(1),
(2) Date: Sep. 6, 2022

(87) PCT Pub. No.: WO2021/185558
PCT Pub. Date: Sep. 23, 2021

(65) Prior Publication Data

US 2023/0116702 A1 Apr. 13, 2023

(30) Foreign Application Priority Data

Mar. 18, 2020 (EP) ..... 20020124

(51) Int. Cl.
*B65H 31/32* (2006.01)

(52) U.S. Cl.
CPC ..... *B65H 31/32* (2013.01); *B65H 2402/60* (2013.01); *B65H 2553/414* (2013.01);
(Continued)

(58) Field of Classification Search
CPC ..... B65H 31/32; B65H 2553/45; B65H 2553/81; B65H 2801/84; B65H 2553/414;
(Continued)

(56) References Cited

U.S. PATENT DOCUMENTS 4,799,847 A 1/1989 Bodewein
5,284,089 A 2/1994 Buck et al.
(Continued)

FOREIGN PATENT DOCUMENTS

CN 109121409 A 1/2019
DE 20103326 U1 5/2001
(Continued)

*Primary Examiner* — Jeremy R Severson
(74) *Attorney, Agent, or Firm* — Bookoff McAndrews, PLLC

(57) ABSTRACT

A sheet pile supporting assembly (24) for a sheet material processing machine is presented. It comprises a plurality of sheet pile supporting bars (28) and a movable guiding means for selectively moving one or more of the sheet pile supporting bars (28) from a retracted position to an extended position. Additionally, an automatic selection unit (30) is provided for automatically selecting the sheet pile supporting bars (28) to be moved to the extended position and for coupling the selected sheet pile supporting bars (28) to the movable guiding means. Moreover, a method for operating a sheet pile supporting assembly (24) for a sheet material processing machine is explained.

16 Claims, 9 Drawing Sheets

Figure 1:
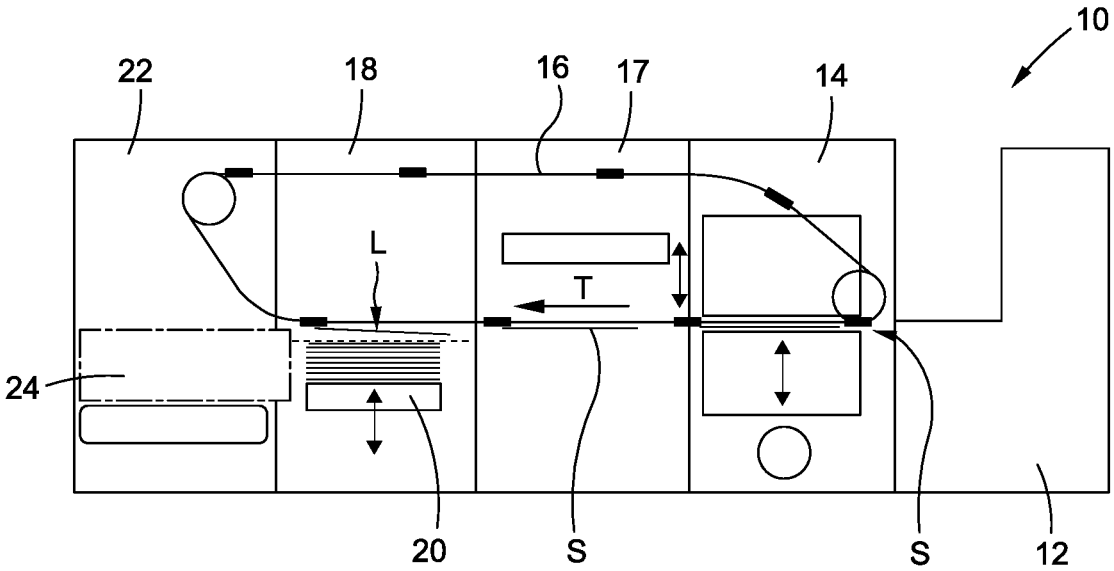

(52) U.S. Cl.
CPC ..... *B65H 2553/45* (2013.01); *B65H 2553/81* (2013.01); *B65H 2801/42* (2013.01); *B65H 2801/84* (2013.01)

(58) Field of Classification Search
CPC ..... B65H 2801/42; B65H 2402/60; B65H 2405/323
See application file for complete search history.

(56) References Cited

U.S. PATENT DOCUMENTS

| | | | | |
|---|---|---|---|---|
| 8,770,580 | B2 * | 7/2014 | Jakob | B65H 31/32 414/790.8 |
| 9,481,541 | B2 | 11/2016 | Cugnoni et al. | |
| 2001/0053393 | A1 | 12/2001 | Baumann et al. | |
| 2002/0028130 | A1 | 3/2002 | Naldi | |
| 2009/0020944 | A1 | 1/2009 | Ide et al. | |
| 2013/0140763 | A1 | 6/2013 | Jakob | |
| 2015/0050113 | A1 | 2/2015 | Cugnoni | |
| 2015/0259170 | A1 | 9/2015 | Fauconneau et al. | |

FOREIGN PATENT DOCUMENTS

| | | | |
|---|---|---|---|
| DE | 102017208165 | A1 | 11/2018 |
| EP | 0875475 | A2 | 11/1998 |
| JP | H01226626 | A | 9/1989 |
| JP | H06138728 | A | 5/1994 |
| JP | 2002011597 | A | 1/2002 |
| JP | 2015516319 | A | 6/2015 |
| WO | 2013143690 | A1 | 10/2013 |
| WO | 2022084038 | A1 | 4/2022 |
| WO | 2022129353 | A1 | 6/2022 |

* cited by examiner

SHEET PILE SUPPORTING ASSEMBLY AND METHOD FOR OPERATING A SHEET PILE SUPPORTING ASSEMBLY

CROSS-REFERENCE TO RELATED APPLICATION(S)

This application is a National Stage Application under 35 U.S.C § 371 of International Patent Application No. PCT/EP2021/054905, filed on Feb. 26, 2021, which claims priority to European Patent Application No. 20020124.2, filed on Mar. 18, 2020, the entireties of which are incorporated herein by reference.

The invention relates to a sheet pile supporting assembly for a sheet material processing machine, especially for a cardboard or paper processing machine. The sheet pile supporting assembly comprises a plurality of sheet pile supporting bars extending substantially in parallel and being movable between a retracted and an extended position respectively, wherein the sheet pile supporting bars are adapted to support a sheet pile while in the extended position only.

Furthermore, the invention relates to a method for operating such a sheet pile supporting assembly.

Sheet pile supporting assemblies of this kind and corresponding methods for operating such sheet pile supporting assemblies are known in the art. They may be used in combination with sheet material cutting machines or sheet material blanking machines, e.g. paper cutting machines or paper blanking machines.

The known sheet pile supporting assemblies are adapted for temporarily supporting a sheet pile comprising a plurality of sheets stacked one upon the other. These sheets may be a product or an intermediate product produced by the sheet material processing machine. The use of a sheet pile supporting assembly usually is necessary during the change of a pallet or when a separation sheet needs to be placed in the pile at the output of the machine. To this end the sheet pile supporting bars are moved from their respective retracted position to their respective extended position.

The sheet pile supporting bars may also be called swords and the sheet pile supporting assembly may also be called a non-stop rack or simply a non-stop.

Known sheet pile supporting assemblies need to be adapted to the sheet material processing machine in which they are used. Furthermore, they need to be configured to the specific job performed on this machine. This is due to the fact that usually specific jobs require specific tools to be mounted inside the sheet material processing machine.

The configuration of the sheet pile supporting assembly comprises the selection of a group of sheet pile supporting bars to be moved to the respective extended position when the sheet pile supporting assembly shall be used for supporting a sheet pile. The remaining sheet pile supporting bars will be locked in their respective retracted position and will not move during the use of the sheet pile supporting unit. The reason thereof is that the latter sheet pile supporting bars will geometrically interfere with parts of the sheet pile processing machine and/or parts of the specific tool used therein, when being moved to the respective extended position. Such interference needs to be avoided. In other words, collisions between sheet pile supporting bars and the sheet material processing machine and the tool have to be avoided.

Usually the configuration of the sheet pile supporting assembly is done manually by experienced operators. These operators transversally displace the bars to avoid said interferences when being moved to the respective extended position. In other systems, the bars do not move transversally. The ones that will move to an extended position are selected by manually moving them into "selected" state. US 2013/0140763 discloses such a system where the user selects the bars manually, either physically or on the machine computer. Said system lacks the ability to choose automatically the configuration of the sheet pile supporting assembly adapted to the specific job performed on this machine.

The problem to be solved by the present invention is to further improve the configuration of the sheet pile supporting assembly. In doing so, the time for configuring the sheet pile supporting assembly shall be reduced. Additionally, the reliability of the configuration shall be enhanced in that collisions between the sheet pile supporting bars and other parts of the sheet pile processing machine or the tool mounted therein shall be strictly avoided.

The problem is solved by a sheet pile supporting assembly of the type mentioned above, comprising a movable guiding means for selectively moving one or more of the sheet pile supporting bars from the retracted position to the extended position and an automatic selection unit for automatically selecting the sheet pile supporting bars to be moved to the extended position and for coupling the selected sheet pile supporting bars to the movable guiding means. The automatic selection unit selects only such sheet pile supporting bars which will not interfere with the sheet material processing machine and especially will not interfere with the tool mounted therein, when moved to the respective extended position. Only the selected sheet pile supporting bars are coupled to the movable guiding means. This process may be performed in substantially less time than a corresponding manual process. Therefore, change-over times between different jobs to be performed on the sheet material processing machine may be significantly reduced. Furthermore, the automatic selection allows for safe operation of the sheet pile supporting unit. Contacts between the sheet pile supporting bars and the remaining parts of the sheet material processing machine and/or the tool are strictly avoided. By automatic selection we mean that there is a device within the machine, which is able to select the sheet pile supporting bars, but does not imply that the process of determining which bar will be selected be necessarily fully automated.

The sheet pile supporting assembly is mainly meant to the used at the output of the machine where the sheets processed by the machine are delivered.

According to an embodiment the selection unit comprises a scanner unit, for example an optical scanner unit, adapted for the detection of geometrical obstacles in an extension space associated with the sheet pile supporting bars. In other words, the scanner unit is able to detect for every single sheet pile supporting bar if it can be moved to the respective extended position without interfering with other parts of the sheet material processing machine. The geometrical obstacles may be parts of a tool used in the sheet material processing machine, especially a blanking tool for separating, for example, the many layouts present on a single sheet of cardboard, or in general parts of the sheet material processing machine. Sheet pile supporting bars for which such a geometrical obstacle has been detected will not be selected for supporting a sheet pile. Consequently, reliable operation of the sheet pile supporting assembly is ensured.

The scanner unit may be movable along a width direction of the sheet pile supporting assembly, especially wherein the scanner unit is movably coupled to a rail extending in the width direction. In doing so, the scanner unit is able to scan the entire extension space for the sheet pile supporting bars. Consequently, geometrical obstacles may be reliably detected. Moreover, a relatively small scanner unit may be used.

Advantageously, the scanner unit comprises a light source, especially a laser, a reflector unit and a light sensor, wherein the obstacles are detected by analyzing the light emitted by the light source and reflected by the reflector unit. In this context, the light source and the light sensor may be arranged on one side of the extension space, which advantageously corresponds to the side where the sheet pile supporting assembly is arranged. The reflector unit is preferably arranged on an opposing side of the extension space. In this configuration, a light beam may be emitted by the light source in the direction of the reflector unit. The light sensor will analyze the reflected light and is adapted for assessing if the reflected light results form a reflection on the reflector unit or elsewhere. Consequently, obstacles inside the extension space may be detected in a reliable and quick manner.

In a variant a first locking unit is provided for locking selected sheet pile supporting bars on the movable guiding means such that the selected sheet pile supporting bars may be moved to the extended position by the movable guiding means. Thus, only such sheet pile supporting bars will be connected to the movable guiding means, which will not interfere with the sheet material processing machine when moved to the respective extended position. Thus, reliable operation of the sheet pile supporting assembly is guaranteed.

According to an alternative a stationary guiding means is provided having a second locking unit for locking non-selected sheet pile supporting bars on the stationary guiding means such that the non-selected sheet pile supporting bars are retained in the retracted position by the stationary guiding means. Consequently, all sheet pile supporting bars which bear the risk of interfering with the sheet material processing machine and/or the tool during operation are locked on the stationary guiding means. Unintended moving of these sheet pile supporting bars is thus reliably avoided.

The first locking unit may comprise a locking bar substantially extending over a width direction of the movable guiding means and/or the second locking unit may comprise a locking bar substantially extending over a width direction of the stationary guiding means. In this configuration both locking bars are adapted for reliably locking every possible sub group of sheet pile supporting bars to the respective guiding means, i.e. to the movable guiding means or the stationary guiding means. Consequently, all sheet pile supporting bars are held in a defined position.

Preferably, the automatic selection unit comprises an engagement unit for selectively moving each sheet pile supporting bar into an engaged position on the stationary guiding means or into an engaged position on the movable guiding means, especially wherein the sheet pile supporting bars are moved along their respective longitudinal extension. Preferably, the sheet pile supporting assembly is configured such that the sheet pile supporting bars may only be locked on the movable guiding means or the stationary guiding means, when in the respective engaged position.

In a further preferred alternative, the engaged position on the movable guiding means is arranged between a home position and an extended position of each sheet pile supporting bar.

The engaged position on the stationary guiding means is preferably arranged on a side of the home position opposing the engaged position on the movable guiding means.

In this configuration, the sheet pile supporting bars only need to be moved by a small increment in order to be placed in the engaged position on the stationary or the movable guiding means. Such a process may be performed within a short time.

The engagement unit may comprise an engagement finger being movable along a width direction of the sheet pile supporting assembly and being configured for individually moving the sheet pile supporting bars into one of the engagement positions. Thus, the engagement finger may be adapted for selectively moving each individual sheet pile supporting bar by a small increment towards the respective extended position or away from the respective extended position. In doing so, the engagement finger may be moved along the width direction of the sheet pile supporting unit in order to be able to move each sheet pile supporting bar to the correct engagement position.

Furthermore, the problem is solved by a method of the type mentioned above for operating a sheet pile supporting assembly for a sheet material processing machine, wherein a group of sheet pile supporting bars to be moved to the extended position for supporting a sheet pile is selected automatically. In doing so the sheet pile supporting assembly may be quickly and reliably adapted and configured to new jobs to be performed on a corresponding sheet material processing machine. Additionally, unintended interference of the sheet pile supporting bars with the sheet material processing machine and/or a tool mounted thereon is avoided.

The automatic selection may comprise the detection of geometrical obstacles hindering one or more sheet pile supporting bars when moved to the respective extended position, especially by scanning an extension space associated with the sheet pile supporting bars. The geometrical obstacles may result from a tool arranged within a sheet material processing machine or from parts of the sheet material processing machine itself. The scanning process is able to quickly and reliably detect such obstacles.

Advantageously, a sensor unit is moved along a scanning direction being substantially orthogonal to the extension of the sheet pile supporting bars for detecting the obstacles. Thus, an extension space of the sheet pile supporting bars may be fully scanned within a relatively short time. Furthermore, a relatively simple sensor is sufficient for this task. Especially, a one-dimensional or two-dimensional sensor is sufficient for scanning the extension space in two, respectively three dimensions.

The sheet pile supporting bars for which no obstacle is detected may be selected for being moved to the extended position. These sheet pile supporting bars do not risk interfering with other parts of the sheet material processing machine.

Alternatively, the automatic selection using the sensor unit can be adjusted manually by the operator with the machine user interface to correct the set of pile supporting bars to be moved in the extended position. Also the operator may determine from scratch which of the pile supporting bars will be part of the selection on the machine user interface (By automatically selecting the bars, we mean that there is no physical intervention of the operator on the bar themselves, i.e. that they are selected physically by a device in the machine).

In an embodiment the selected sheet pile supporting bars are coupled to a movable guide means, especially wherein the selected sheet pile supporting bars are conjointly moved to the extended position by the movable guide means. In other words, all selected sheet pile supporting bars are moved together by the movable guide means.

Preferably, the sheet pile supporting bars which are not selected are coupled to a stationary guide means, especially wherein the non-selected sheet pile supporting bars are retained in the retracted position by the stationary guide means. Consequently also the non-selected bars are in a well-defined position.

Figure 2:
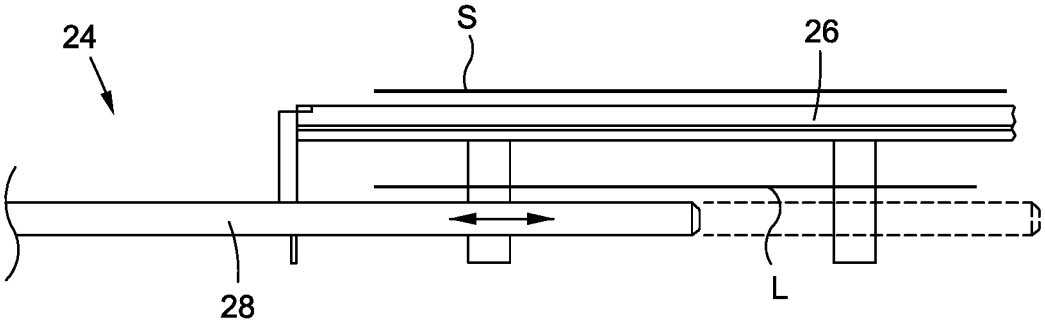
Figure 3:
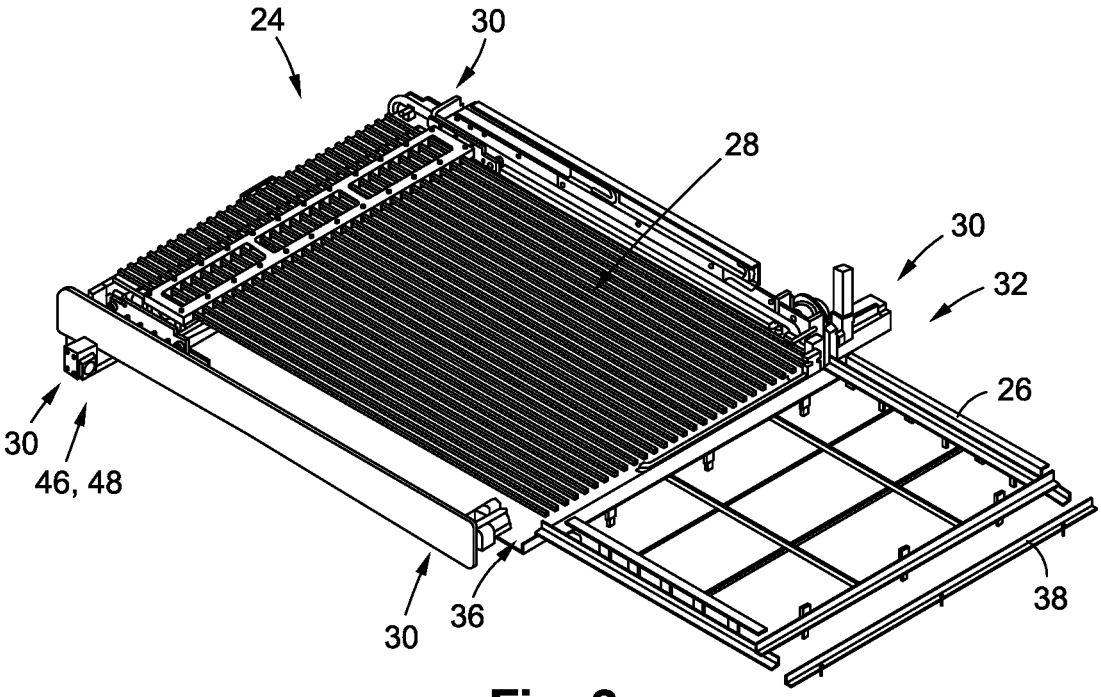
Figure 4:
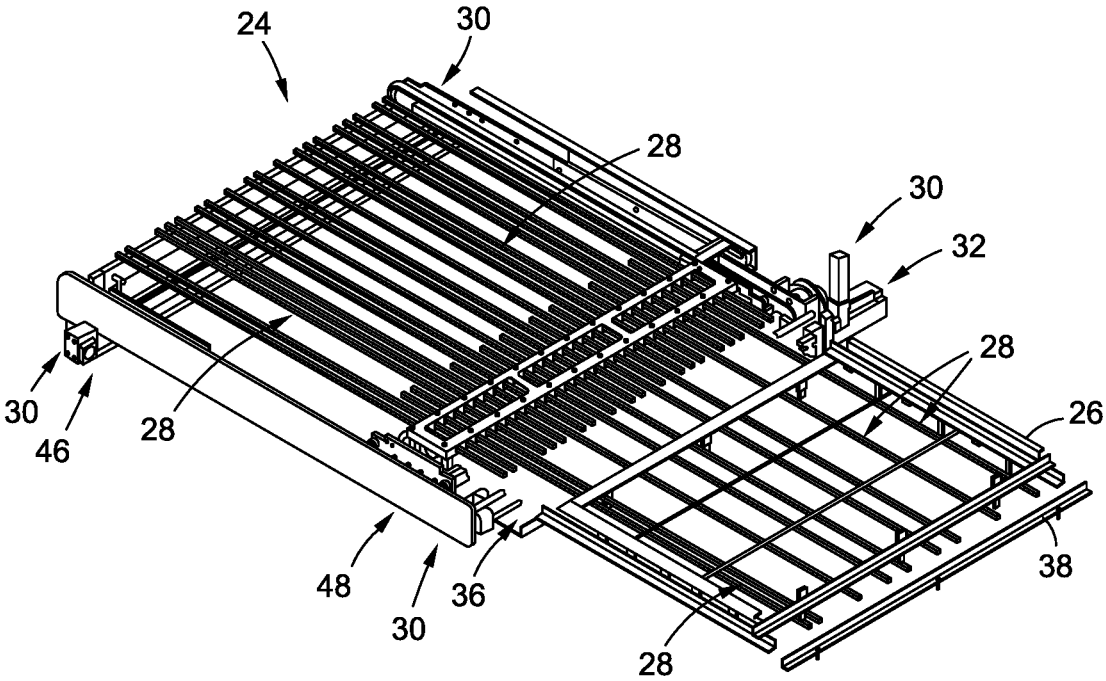
Figure 5:
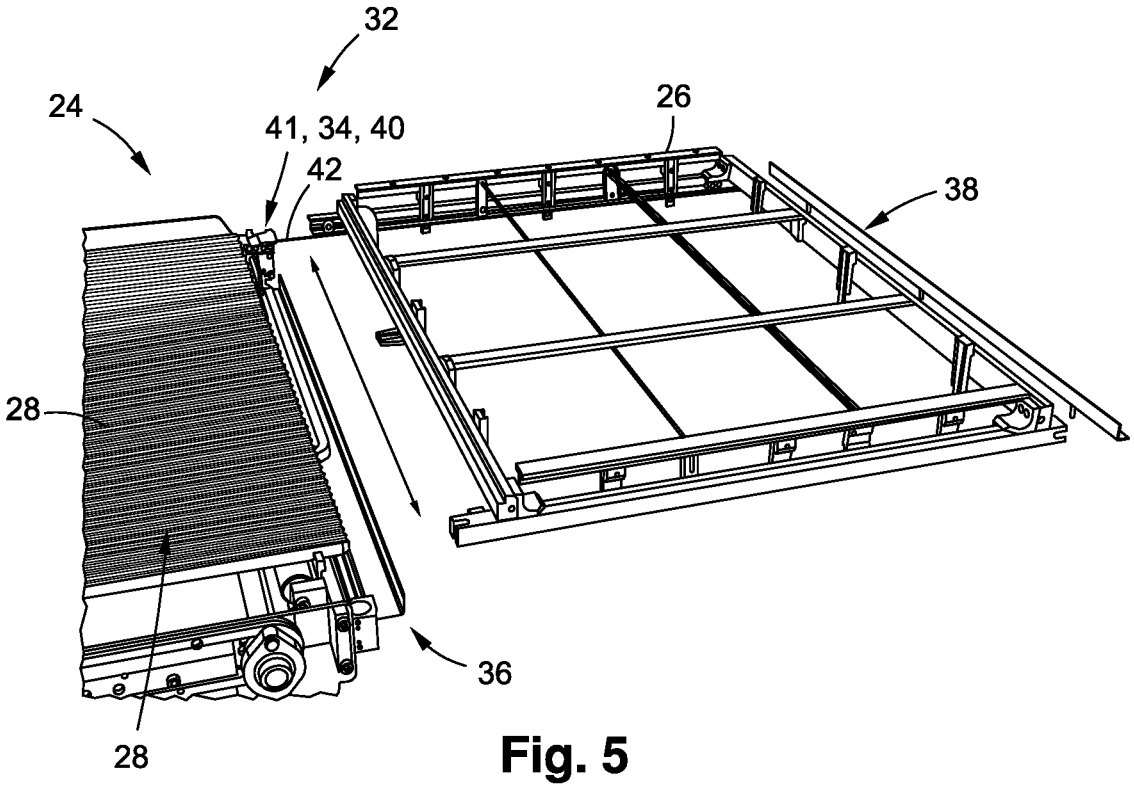
Figure 6:
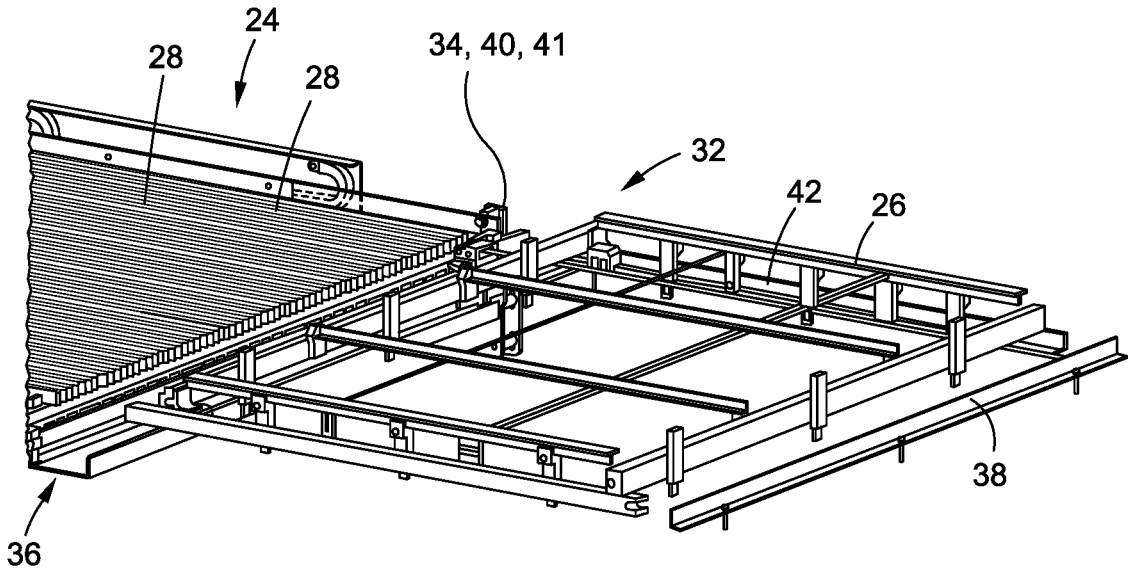
Figure 7:
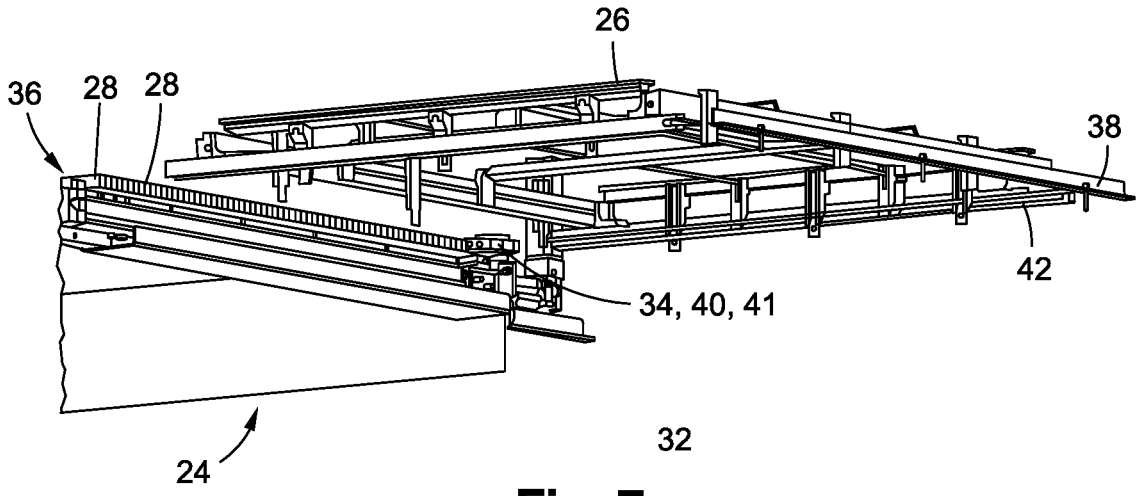
Figure 8:
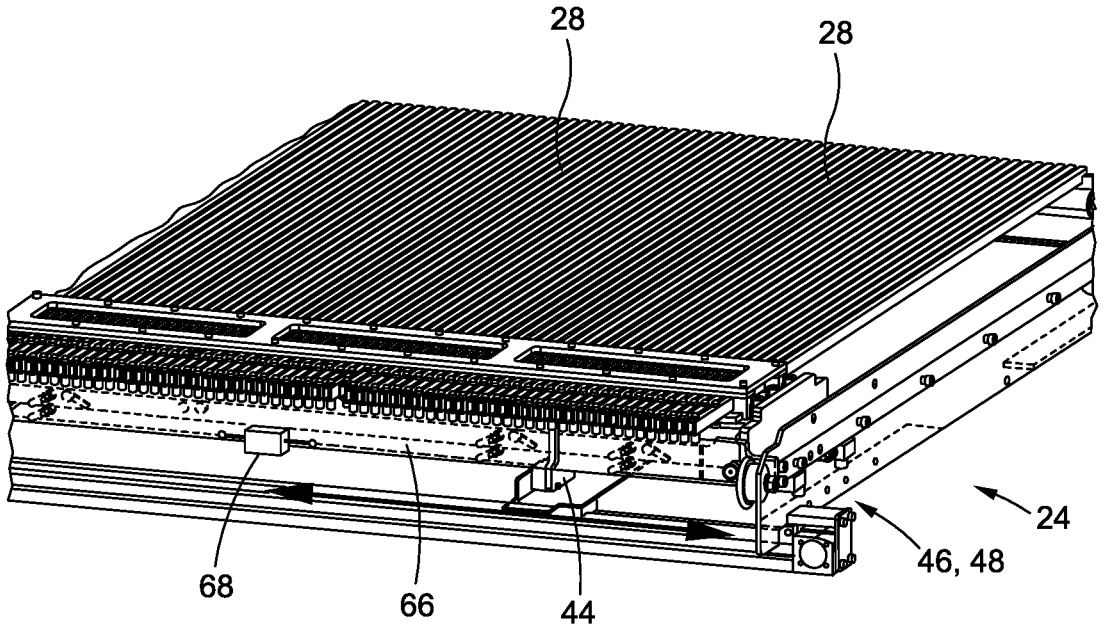
Figure 9:
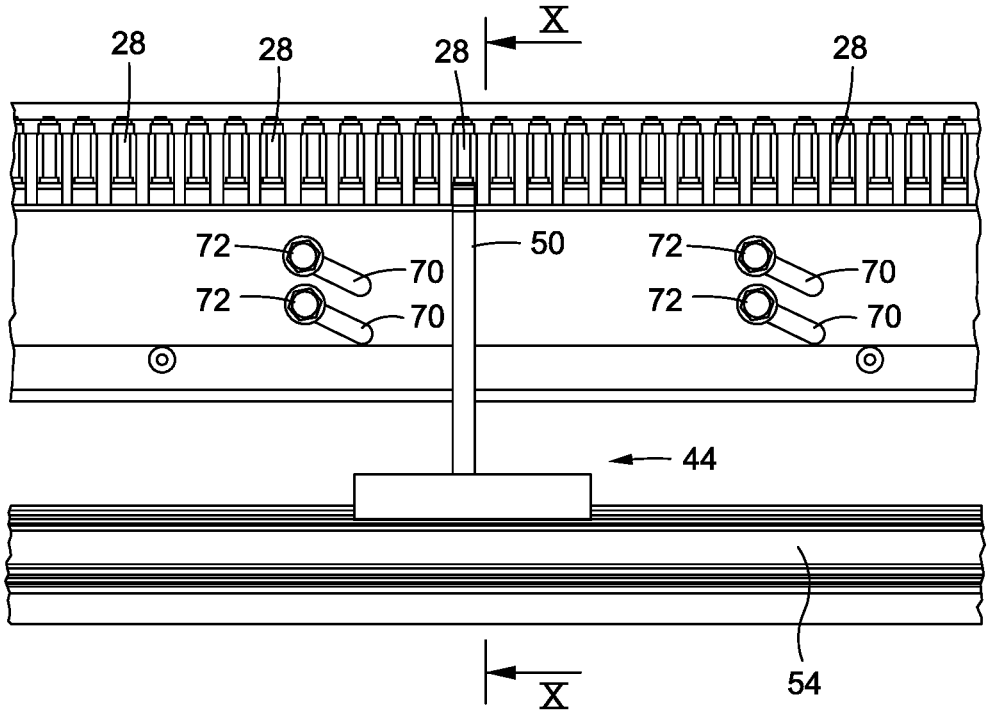
Figure 10:
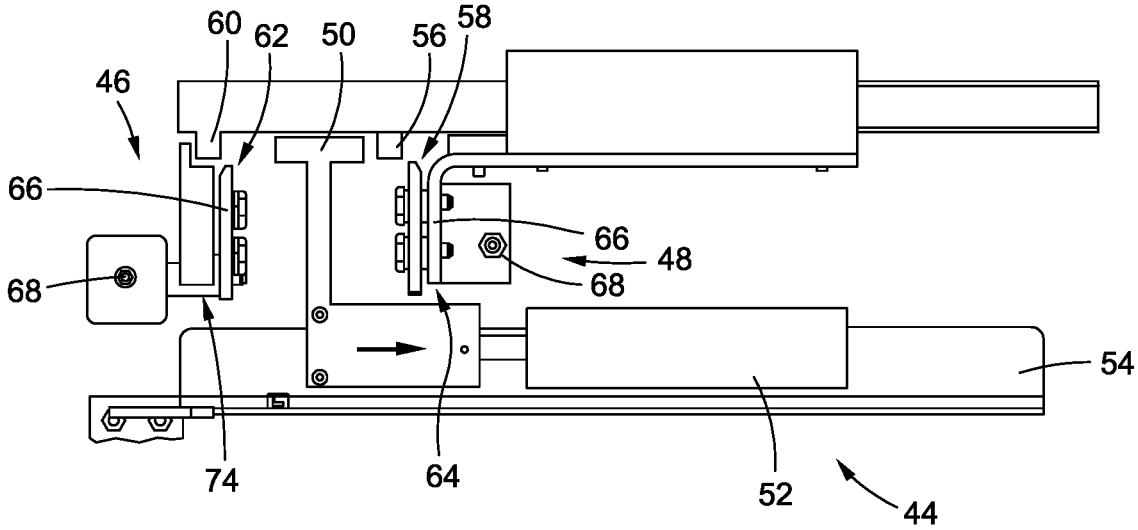
Figure 11:
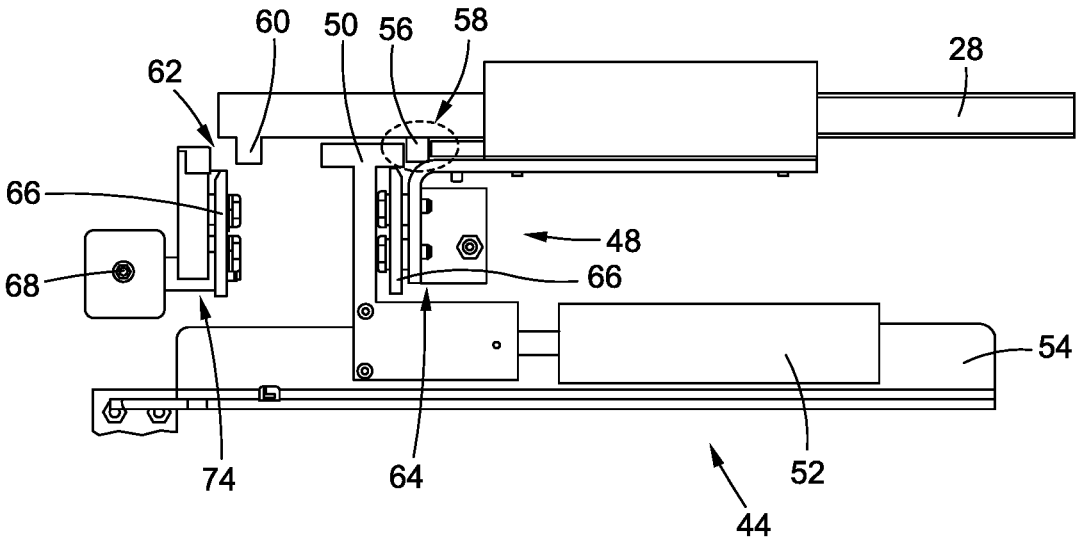
Figure 12:
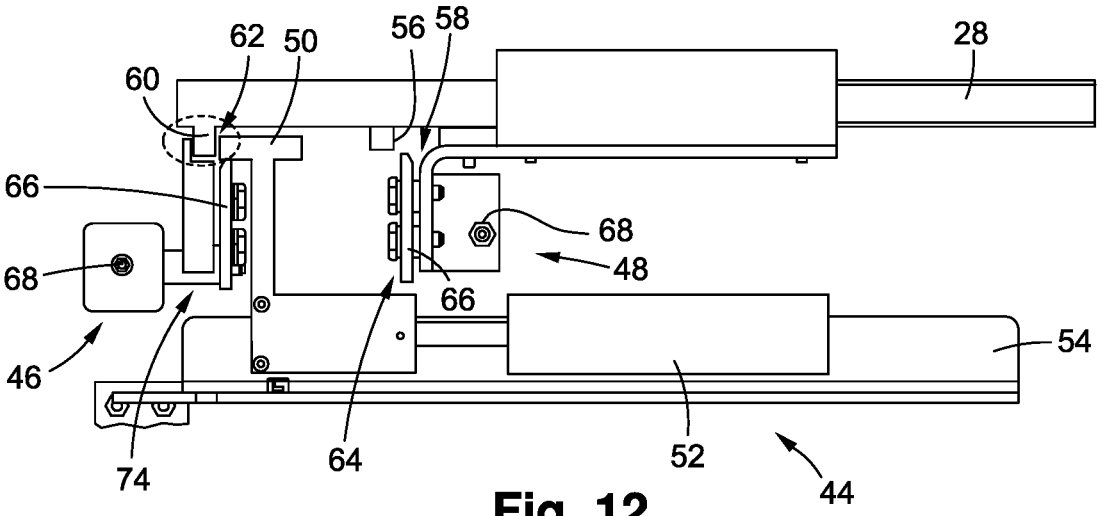
Figure 13:
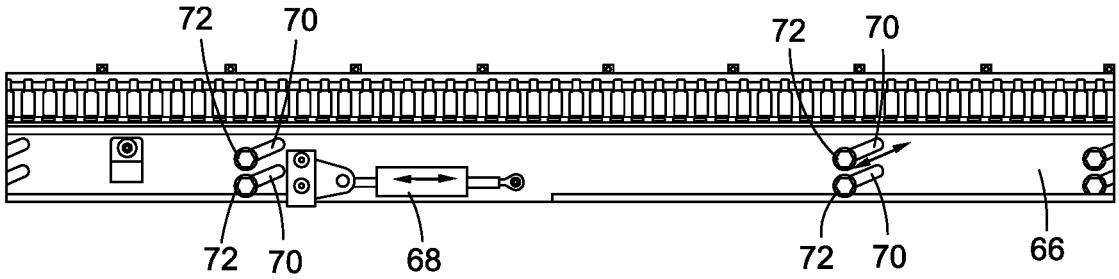
Figure 14:
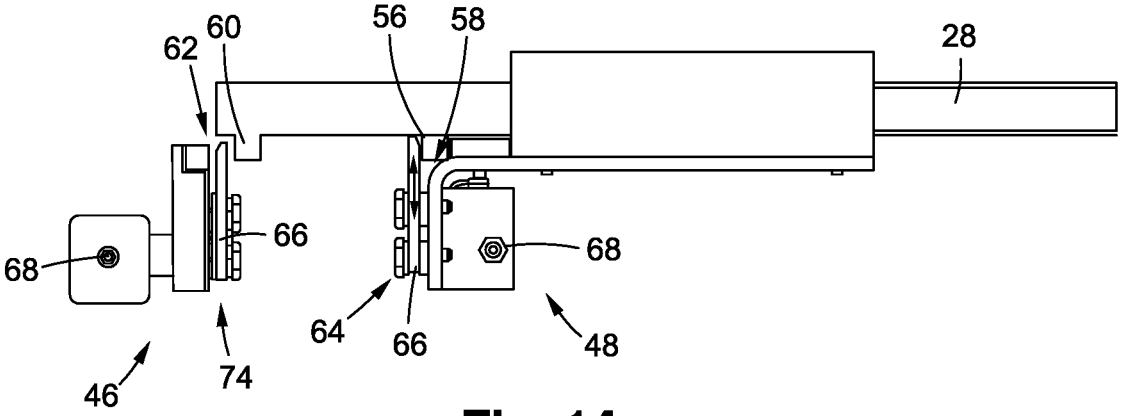
Figure 15:
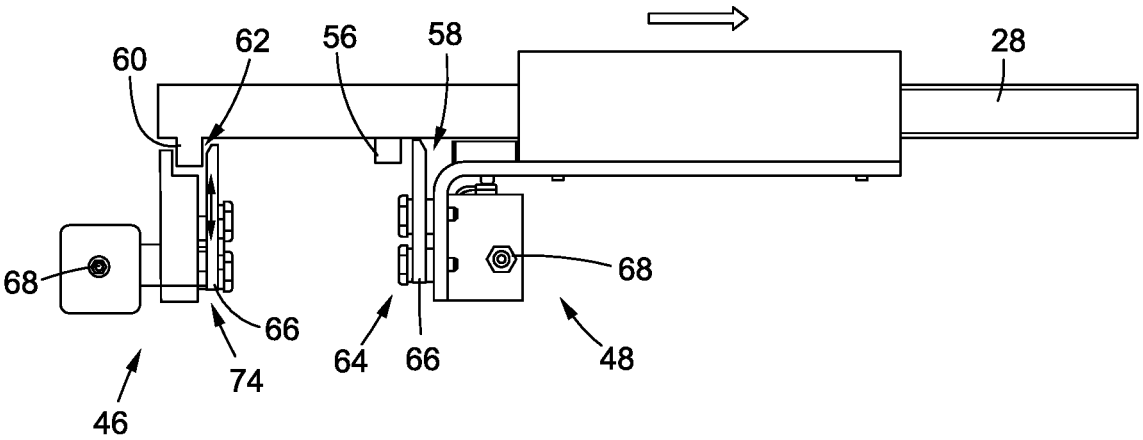
Figure 16:
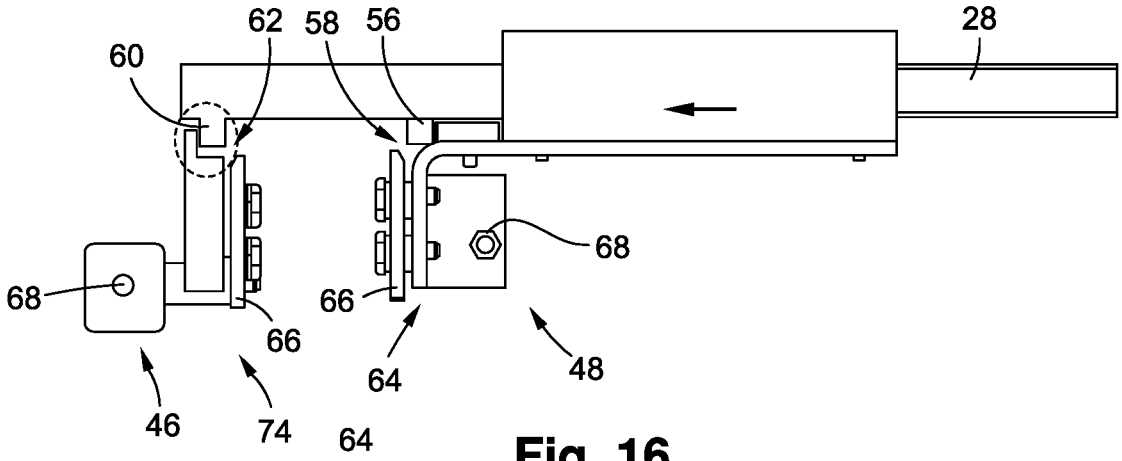
Figure 17:
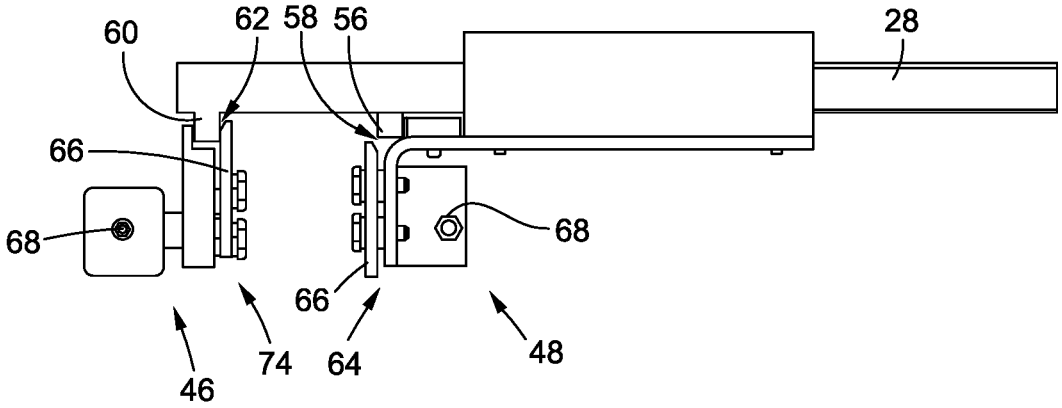
Figure 18:
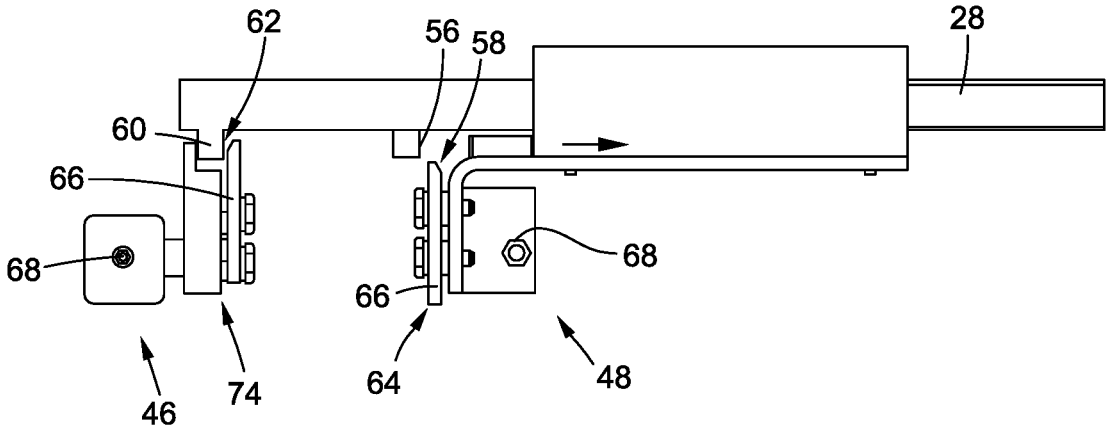
Figure 19:
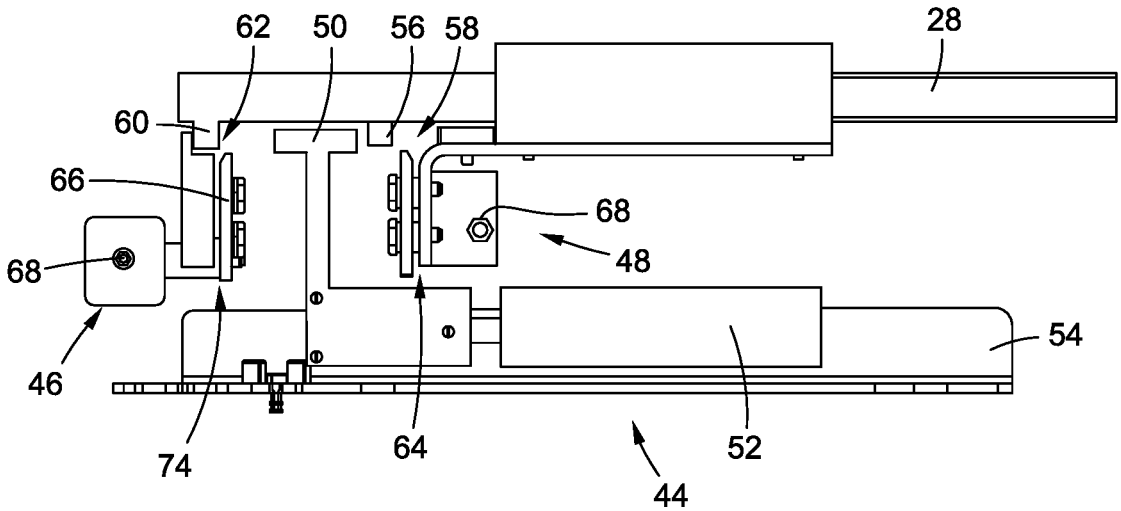

The invention will now be described with reference to the enclosed drawings. In the drawings, FIG. 1 is a schematic view of a paper processing machine comprising a sheet pile supporting assembly according to the invention, FIG. 2 is a schematic view of a sheet pile supporting bar and a tool illustrating the working principle of a sheet pile supporting assembly according to the invention, FIG. 3 is a perspective view of a sheet pile supporting assembly according to the invention and a tool, wherein all sheet pile supporting bars are in their respective retracted position, FIG. 4 is another perspective view of the sheet pile supporting assembly of FIG. 3 and the tool of FIG. 3, wherein some of the sheet pile supporting bars are in their respective extended position, FIG. 5 is a more detailed perspective view of the sheet pile supporting assembly of FIG. 3 and the tool of FIG. 3, FIG. 6 is a perspective view of the sheet pile supporting assembly of FIG. 5 and the tool of FIG. 5, wherein a different perspective is taken as compared to FIG. 5, FIG. 7 is a perspective view of the sheet pile supporting assembly of FIGS. 5 and 6 and the tool of FIGS. 5 and 6, wherein a different perspective is taken as compared to FIGS. 5 and 6, FIG. 8 is a perspective view of the sheet pile supporting assembly of FIGS. 3 to 7 showing an engagement unit, FIG. 9 is a detail view of the sheet pile supporting assembly of FIGS. 3 to 8, especially showing an engagement unit thereof, FIG. 10 is a sectional view X-X of the sheet pile supporting assembly of FIG. 9, wherein an engagement finger is in a home position, FIG. 11 is view corresponding to FIG. 10, wherein the engagement finger is in an extended position, FIG. 12 is view corresponding to FIGS. 10 and 11, wherein the engagement finger is in a retracted position, FIG. 13 is a further detail view of the sheet pile supporting assembly of FIGS. 3 to 8, showing a locking bar and a corresponding actuator, FIG. 14 is an additional detail view of the sheet pile supporting assembly of FIGS. 3 to 8, especially showing the locking of selected sheet pile supporting bars, FIG. 15 is a detail view corresponding to FIG. 14, especially showing the locking of non-selected sheet pile supporting bars, FIG. 16 is a detail view corresponding to FIGS. 14 and 15, especially showing a first operational state during a reset procedure, FIG. 17 is a detail view corresponding to FIGS. 14 to 16, especially showing a second operational state during a reset procedure, FIG. 18 is a detail view corresponding to FIGS. 14 to 17, especially showing a third operational state during a reset procedure, and FIG. 19 is a detail view corresponding to FIGS. 14 to 18, especially showing a fourth operational state during a reset procedure.

FIG. 1 shows a paper processing machine 10 being a paper blanking machine in the example shown.

It comprises a feeder module 12 for feeding paper sheets S into the paper processing machine 10. These sheets S are transported to a blanking module 14 by a conveyor belt 16. The traveling direction is indicated by arrow T.

In the blanking module 14 a layout L is cut from the paper sheet S.

In this context the layout L is defined as the usable part of the sheet material, which may generally be composed of one or multiple blanks.

Subsequently, the paper sheet S with the cut layout L is transported to a waste stripping module 17, where the layouts L are separated from some of the waste.

Subsequently, the paper sheet S with the cut layout L is transported to a blanking module 18, where the layouts L are separated from each other and from the remaining waste.

The layout L is placed on a pallet 20 and the waste is directed to a waste evacuation module 22.

With each layout L arriving on the pallet 20, the position of the pallet 20 is lowered by an increment substantially corresponding to a thickness of the layout L.

The paper processing machine 10 also comprises a sheet pile supporting assembly 24. Its general structure and functionality will be explained in connection with FIG. 2, which also shows a stripping tool 26 used for separating the layout L from the sheet S.

The sheet pile supporting assembly 24 is represented by a single sheet pile supporting bar 28, which is shown in an intermediate position, i.e. neither fully retracted nor fully extended. A fully extended position of the sheet pile supporting bar 28 is shown in dotted lines and a fully retracted position of the sheet pile supporting bar 28 in dashed lines.

The sheet pile supporting bar 28 is used for supporting a sheet pile, in the present context more precisely a layout pile, during the change of the pallet 20.

This means that shortly before a pallet 20 is to be exchanged, or shortly before that an insert sheet is inserted on the sheet pile, the sheet pile supporting bar 28 is moved from a retracted position to an extended position.

Also, shortly before that an insert sheet is inserted on the sheet pile, the sheet pile supporting bar 28 is moved from a retracted position to an extended position. The insert sheet is inserted by a device (not shown) positioned below the supporting bars. The insert sheet is used to keep the sheet pile as a single pile despite having several separated layouts at each layer of the pile, or as a mean to count the number of blanks on a pile output from the machine.

The sheet pile supporting bars 28 are adapted to support a sheet pile while in the extended position only.

Consequently, the layouts L being separated from each other and from the waste in the blanking module 18 will no longer be placed on top of a pile being supported by the pallet 20, but on the sheet pile supporting bar 28 or a sheet pile being supported on the sheet pile supporting bar 28.

As will be explained later, the sheet pile supporting assembly 24 comprises a plurality of sheet pile supporting bars 28 which are arranged such that in their extended position they form a plane for supporting a sheet pile. Consequently, the sheets will be supported by a plurality of sheet pile supporting bars 28.

Then the pallet 20 may be withdrawn from the paper processing machine 10 and a new pallet 20 may be placed underneath the sheet pile supporting bar 28.

Subsequently, the sheet pile supporting bar 28 may be moved to the retracted position, thereby placing the sheet pile supported thereon on the newly installed pallet 20.

A more detailed view of the sheet pile supporting assembly 24 may be seen in FIGS. 3 to 8.

It comprises a plurality of sheet pile supporting bars 28 extending substantially in parallel and being movable between a retracted (cf. FIG. 3) and an extended position respectively.

In FIG. 3 all sheet pile supporting bars 28 are in the respective retracted position. In FIG. 4, however, some of the sheet pile supporting bars 28 are in the respective extended position. In this position they are placed at an underside of the tool 26, that is, below the top of the tool, but still within or partly within the tool.

It is noted that for the pure reason of better legibility only some of the sheet pile supporting bars 28 in FIGS. 3 and 4 are equipped with a reference sign. This also applies to the remaining Figures.

As can be seen from FIGS. 2 to 7, an extension space into which the sheet pile supporting bars 28 are moved, when taking their respective extended position comprises obstacles, e.g. in the form of parts of the tool 26. In this context, the extension space is defined as the space being occupied by the sheet pile supporting bars 28 when all of them are in the extended position.

This leads to the fact that some of the sheet pile supporting bars 28 must not be moved to their respective extended position in order to avoid interference or collision with the tool 26. Put otherwise, the sheet pile supporting bars 28 which will be moved to their respective extended position during the use of the sheet pile supporting assembly 24 must be carefully selected.

To this end an automatic selection unit 30 for automatically selecting the sheet pile supporting bars 28 to be moved to the extended position is provided.

It comprises a scanner unit 32 adapted for the detection of geometrical obstacles in the extension space for the sheet pile supporting bars 28.

The scanner unit 32 comprises a light source 34, which is a laser source in the example shown.

The light source 34 is mounted on a rail 36 substantially extending over the entire width direction to the sheet pile supporting assembly 24. Consequently, the light source 34 is movable along this width direction.

The light source 34 is adapted for interacting with a reflector unit 38 which is arranged on an opposing side of the tool 26 as compared to the light source 34.

The scanner unit 32 additionally comprises a light sensor 40.

In the example shown the light source 34 and the light sensor 40 form a movable sensor unit 41.

Consequently, the scanner unit 32 is adapted for detecting obstacles in the extension space in that the light source 34 emits a light beam 42 in the direction of the reflector unit 38.

Two cases have to be distinguished for each position of the light source 34 on the rail 36.

Either the light beam 42 is reflected by the reflector unit 38 only. The reflected light beam then is detected by the light sensor 40.

Or the light beam 42 is only partially reflected by the reflector unit 38 or reflected by any other object. Also in this case the reflected light beam is detected by the light sensor 40.

Due to the fact that the reflector unit 38 is configured such that only minor optical losses occur during the reflection of the light beam 42, the light sensor 40 detects light of relatively high intensity, when the light beam 42 is reflected by the reflector unit 38 only.

In the case where the light beam is not entirely reflected by the reflector unit 38, only light of a minor intensity is detected by the light sensor 40.

Consequently, the scanner unit 32 is adapted for detecting obstacles in the extension space by analyzing the light emitted by the light source 34 and reflected by the reflector unit 38.

Alternatively, instead of the scanner 32 we could use a light barrier, adapted for the detection of geometrical obstacles in the extension space for the sheet pile supporting bars 28. It could, for example be positioned just above or below the bars 28.

Alternatively, instead of the scanner 32 we could a sensor placed at the tip of each bar 28, adapted for the detection of geometrical obstacles in the extension space for the sheet pile supporting bars 28.

Thus, an information about the sheet pile supporting bars 28 which can be moved to the extended position without interfering with the tool 26 and/or a part of the paper processing machine 10 is generated.

These sheet pile supporting bars 28 will be selected for the operation of the sheet pile supporting assembly 24.

The automatic selection unit 30 is also adapted for coupling the selected sheet pile supporting bars 28 to a movable guiding means 48. This will be explained in connection with FIGS. 9 to 15.

The automatic selection unit 30 comprises an engagement unit 44 which is adapted for selectively moving each sheet pile supporting bar 28 into an engaged position a stationary guiding means 46 or into an engaged position on the movable guiding means 48.

Thereby, all selected sheet pile supporting bars 28 will be moved into an engaged position on the movable guiding means 48 and all non-selected sheet pile supporting bars 28 will be moved into an engaged position on the stationary guiding means 46.

The engagement unit 44 comprises an engagement finger 50 which is coupled to an actuator 52 such that it is movable substantially along a longitudinal extension of the sheet pile supporting bars 28.

Additionally, the engagement finger 50 and the actuator 52 are mounted on a rail 54 such that they can be moved along the rail 54 in a width direction of the sheet pile supporting assembly 24.

The functionality will be explained starting from a home position of the engagement finger 50 represented in FIG. 10.

The engagement finger 50 has taken a position along the rail 54, which is associated with the sheet pile supporting bar 28 highlighted in FIG. 9.

If based on the information generated by the scanning unit 32, this sheet pile supporting bar 28 is to be selected, it needs to be moved into—or kept in—an engaged position on the movable guiding means 48. To move the pile supporting bar 28, the engagement finger 50 is moved towards the movable guiding means 48 thereby engaging the sheet pile supporting bar 28 by a first cam 56 thereof and moving the first cam 56 into a corresponding cam reception space 58 on the movable guiding means 48 (cf. FIG. 11). Thus, the sheet pile supporting bar 28 is in the engaged position on the movable guiding means 48.

If based on the information generated by the scanning unit 32, this sheet pile supporting bar 28 is not to be selected, it needs to be moved into—or kept in—an engaged position on the stationary guiding means 46. To move the pile supporting bar 28, the engagement finger 50 is moved towards the stationary guiding means 46 thereby engaging the sheet pile supporting bar 28 by a second cam 60 thereof and moving the second cam 60 into a corresponding cam reception space 62 on the stationary guiding means 46 (cf. FIG. 12). Thus, the sheet pile supporting bar 28 is in the engaged position on the stationary guiding means 46.

This process is repeated for all sheet pile supporting bars 28 of the sheet pile supporting assembly 24 and thus each sheet pile supporting bar 28 is individually moved into one of the engagement positions. The sheet pile supporting bars 28 are especially moved along their respective longitudinal extension.

Subsequently, the selected sheet pile supporting bars 28 and the non-selected sheet pile supporting bars 28 will be locked to the respective stationary guiding means 46 or movable guiding means 48.

To this end, a first locking unit 64 is provided on the movable guiding means 48 for locking the selected sheet pile supporting bars 28 on the movable guiding means 48 which are in the corresponding engaged position.

The first locking unit 64 comprises a locking bar 66 being coupled to a corresponding actuator 68. Furthermore, the locking bar 66 is coupled to the movable guiding means 48 via inclined slots 70 provided on the locking bar 66 cooperating with bolts 72 being fixed to the movable guiding means 48 (cf. FIG. 13).

The locking bar 66 substantially extends over a width direction of the movable guiding means 48.

The locking bar 66 can take an unlocked, lower position in which it does not interfere with the sheet pile supporting bars 28 and a locked, upper position in which it closes the cam reception space 58 on the movable guiding means 48. Consequently, all selected sheet pile supporting bars 28 are locked on the movable guiding means 48.

Consequently, these sheet pile supporting bars 28 may be moved to the extended position by the movable guiding means 48 during operation of the sheet pile supporting assembly 24. Of course, the selected sheet pile supporting bars 28 may also be moved back to the respective retracted position by the movable guiding means 48.

The stationary guiding means 46 is equipped with a second locking unit 74 which also comprises a locking bar 66 of the type shown in FIG. 13. Consequently, the locking bar 66 of the second locking unit 74 is coupled to the stationary guiding means 46 via inclined slots 70 provided on the locking bar 66 cooperating with bolts 72 being fixed to the stationary guiding means 46.

The locking bar 66 of the second locking unit 74 can also take an unlocked, lower position in which it does not interfere with the sheet pile supporting bars 28. Additionally, it can take a locked, upper position in which it closes the cam reception space 62 on the stationary guiding means 46. Consequently, all non-selected sheet pile supporting bars 28 are locked on the stationary guiding means 46. Thus, they are held in a defined position and an unintended interference of these sheet pile supporting bars 28 with parts of the paper processing machine 10 or the tool 26 is avoided.

Consequently, the above described sheet pile supporting assembly 24 may be operated as follows.

In a first step geometrical obstacles in the extension space are detected by scanning. To this end the sensor unit 41 is moved in a direction being substantially orthogonal to the extension of the sheet pile supporting bars 28.

Based on the obstacles detected inside the extension space, the sheet pile supporting bars 28 for which no obstacle has been detected are selected for being moved to the extended position during the use of the sheet pile supporting assembly 24. These sheet pile supporting bars 28 are coupled to the movable guide means 48 as described above.

The remaining sheet pile supporting bars 28 are coupled to the stationary guiding means 46 as has been described before.

In summary, the group of sheet pile supporting bars 28 to be moved to the extended position for supporting a sheet pile is selected automatically.

If a job to be performed on the paper processing machine 10 is to be changed, also the configuration of the sheet pile supporting assembly 24 needs to be changed.

In order to do so, a reset procedure is performed, which will be explained in connection with FIGS. 16 to 19. The reset procedure brings all the pile supporting bars 28 in an engaged position on the stationary guiding means 46.

During this procedure, both the locking bar 66 of the first locking unit 64 and the locking bar 66 of the second locking unit 74 are moved to their respective unlocked, lower positions. The movable guiding means 48 is moved into an override position. The override position is defined by the second cams 60 of the sheet pile supporting bars 28 being moved to the cam reception space 62 by the movable guiding means 48. This means that at the same time the first cams 56 are positioned within the cam reception space 58. In other words, the sheet pile supporting bars are simultaneously in an engaged position on the movable guiding means 48 and the stationary guiding means 46 (cf. FIG. 16). In other words, when the movable guiding means 48 are moved toward the override position all the bars that were in an engaged position on the movable guiding means (48) are pushed toward an engaged position on the stationary guiding means 46. Thus, with a single operation, all the bars are set to the same position.

Afterwards, the locking bar 66 of the second locking unit 74 is moved to the locked position thereby locking all sheet pile supporting bars 28 on the stationary guiding means 46. This includes formerly selected sheet pile supporting bars 28 and formerly non-selected sheet pile supporting bars 28 (cf. FIG. 17).

Then, the movable guiding means 48 is moved to its neutral position, which is within a bigger distance from the stationary guiding means 46 than the override position (cf. FIG. 18).

As a last step of the reset-to-stationary procedure, the locking bar 66 of the second locking unit 74 is moved to the unlocked position (cf. FIG. 19).

Now the sheet pile supporting bars 28 are neither locked to the stationary guiding means 46 nor to the movable guiding means 48.

Consequently, the newly selected sheet pile supporting bars 28 may be brought into a respective engaged position on the movable guiding means 48 by the engagement finger 50 as has already been explained before.

Conversely, a reset-to-movable procedure may be performed similarly to bring all the pile supporting bars 28 toward the movable guiding means 48 and use the engagement finger 50 to bring selected pile supporting bars 28 toward the stationary guiding means 46 prior to locking the bars.

The choice between using a reset-to-stationary or a reset-to-movable may be determined by the number of pile supporting bars 28 that need to be individually moved by the engagement finger 50. The alternative requiring the least number of bar movement being preferred because it may be performed in less time (the time needed for any of the reset procedures being independent from the number of bars moved).

The invention claimed is:

1. A sheet pile supporting assembly for a sheet material processing machine, the sheet pile supporting assembly comprising:

a plurality of sheet pile supporting bars extending substantially in parallel and being movable between a retracted and an extended position respectively, wherein the sheet pile supporting bars are adapted to support a sheet pile while in the extended position, a movable guide for selectively moving one or more of the sheet pile supporting bars from the retracted position to the extended position, and an automatic selection unit for automatically selecting the sheet pile supporting bars to be moved to the extended position and for coupling the selected sheet pile supporting bars to the movable guide, wherein the selection unit comprises a scanner unit adapted for detecting geometrical obstacles in an extension space associated with the sheet pile supporting bars.

2. The sheet pile supporting assembly according to claim 1, wherein the scanner unit is an optical scanner unit.

3. The sheet pile supporting assembly according to claim 1, wherein the scanner unit is movable along a width direction of the sheet pile supporting assembly.

4. The sheet pile supporting assembly according to claim 1, wherein the scanner unit comprises a light source, a reflector unit and a light sensor, wherein the obstacles are detected by analyzing the light emitted by the light source and reflected by the reflector unit.

5. The sheet pile supporting assembly according to claim 1, further comprising:

a first locking unit for locking selected sheet pile supporting bars on the movable guide such that the selected sheet pile supporting bars may be moved to the extended position by the movable guide.

6. The sheet pile supporting assembly according to claim 5, further comprising:

a stationary guide having a second locking unit for locking non-selected sheet pile supporting bars on the stationary guide such that the non-selected sheet pile supporting bars are retained in the retracted position by the stationary guide.

7. The sheet pile supporting assembly according to claim 6, wherein the first locking unit comprises a locking bar substantially extending over a width direction of the movable guide and/or in that the second locking unit comprises a locking bar substantially extending over a width direction of the stationary guide.

8. The sheet pile supporting assembly according to claim 6, wherein the automatic selection unit comprises an engagement unit for selectively moving each sheet pile supporting bar into an engaged position on the stationary guide or into an engaged position on the movable guide.

9. The sheet pile supporting assembly according to claim 8, wherein the engagement unit comprises an engagement finger being movable along a width direction of the sheet pile supporting assembly and being configured for individually moving the sheet pile supporting bars into one of the engagement positions.

10. The sheet pile supporting assembly according to claim 8, wherein the movable guide is suitable for moving toward an override position that sets all the sheet pile supporting bars into a common engagement position.

11. A method for operating a sheet pile supporting assembly for a sheet material processing machine, wherein the sheet pile supporting assembly comprises a plurality of sheet pile supporting bars being movable between a retracted position and an extended position respectively, and wherein the sheet pile supporting bars are adapted to support a sheet pile while in the extended position only, the method comprising:

automatically selecting a group of sheet pile supporting bars to be moved to the extended position for supporting the sheet pile, wherein the automatically selecting the group of sheet pile supporting bars comprises detecting geometrical obstacles hindering one or more sheet pile supporting bars when moved to the respective extended position.

12. The method according to claim 11, wherein the detecting the geometrical obstacles is performed by scanning an extension space associated with the sheet pile supporting bars.

13. The method according to claim 11, wherein the detecting the geometrical obstacles includes moving a sensor unit along a scanning direction being substantially orthogonal to an extension of the sheet pile supporting bars.

14. The method according to claim 11, wherein the automatically selecting the group of sheet pile supporting bars includes selecting the sheet pile supporting bars for which no obstacle is detected.

15. The method according to claim 11, wherein the selected sheet pile supporting bars are coupled to a movable guide.

16. The method according to claim 11, wherein the sheet pile supporting bars which are not selected are coupled to a stationary guide.

* * * * *